US006450928B1

(12) United States Patent
Larkins, Jr.

(10) Patent No.: US 6,450,928 B1
(45) Date of Patent: Sep. 17, 2002

(54) UPPER BODY EXERCISER ASSEMBLY

(76) Inventor: Richard T. Larkins, Jr., 4711 Worthington Rd., Westerville, OH (US) 43082

( * ) Notice: Subject to any disclaimer, the term of this patent is extended or adjusted under 35 U.S.C. 154(b) by 78 days.

(21) Appl. No.: 09/632,311

(22) Filed: Aug. 4, 2000

(51) Int. Cl.[7] ..... A63B 21/072

(52) U.S. Cl. ..... 482/110; 482/106; 482/139

(58) Field of Search ..... 482/45, 93, 94, 482/106, 108, 110, 131, 140, 139; D21/679–682; 446/26, 28, 266

(56) References Cited

U.S. PATENT DOCUMENTS 4,720,096 A * 1/1988 Rogers ..... 482/106
5,024,434 A * 6/1991 Smith ..... 482/106
5,248,287 A * 9/1993 Nicoletti ..... 482/106
5,399,133 A * 3/1995 Haber et al. ..... 482/139
5,407,405 A * 4/1995 Oren ..... 482/139
5,713,823 A * 2/1998 Walendzak et al. ..... 482/142
6,022,300 A * 2/2000 Hightower ..... 482/106

FOREIGN PATENT DOCUMENTS

CH 683967 A5 * 6/1994 ..... 482/108
SU 1146068 A * 3/1985 ..... 482/106

* cited by examiner

*Primary Examiner*—Glenn E. Richman
*Assistant Examiner*—Victor Hwang
(74) *Attorney, Agent, or Firm*—Thomas S. Baker, Jr.

(57) ABSTRACT

An upper body exerciser assembly is comprised of a rigid circular tubular frame, a pair of planar handgrip mounts rigidly joined to the frame in diametrically-opposed relation, and a pair of ball bearing-supported handgrips carried by the planar handgrip mounts and fully rotatable relative thereto.

9 Claims, 4 Drawing Sheets

UPPER BODY EXERCISER ASSEMBLY

CROSS-REFERENCES

None.

FIELD OF THE INVENTION

This invention generally pertains to body exercise equipment for human use, and particularly concerns an upper body exerciser assembly that may be utilized advantageously for the improvement of human upper body joint and muscle conditioning.

BACKGROUND OF THE INVENTION

Many different constructions of upper body exercise equipment for human use are presently known in the United States. U.S. Pat. No. 5,248,287 issued to Nicoletti discloses a circular upper body exercise device which has diametrically-opposed fixed handles that facilitate doing upper body trunk rotation exercises. U.S. Pat. No. 5,407,405 granted to Oren et al. teaches a pivoted handgrip for upper body exercisers that involve an attached or added weight resistance. Further, U.S. Pat. No. 5,080,349 issued to Vittone discloses an upper body exerciser that has pivoted handgrips and also involves working-out against added or attached weights.

I have devised a novel upper body exerciser that does not require the use of attached or added weight resistance in order to obtain improved upper body joint and muscle conditioning and also that utilizes improved handgrips for the exerciser device.

Other objects and advantages of the present invention will become apparent during consideration of the descriptions, drawings, and claims which follow.

SUMMARY OF THE INVENTION

The present invention basically is comprised of tubular metal frame having a full-circle or nearly full-circle configuration, diametrically opposed hand grip mounts positioned in the plane of the tubular frame and welded to it, and improved bearing-supported handgrips carried by the tubular frame handgrip mounts and adapted to fully rotate in the plane of the tubular frame handgrip mounts. The invention tubular metal frame is sized to completely surround the upper torso of the human user of the assembly.

DETAILED DESCRIPTION

Figure 1:
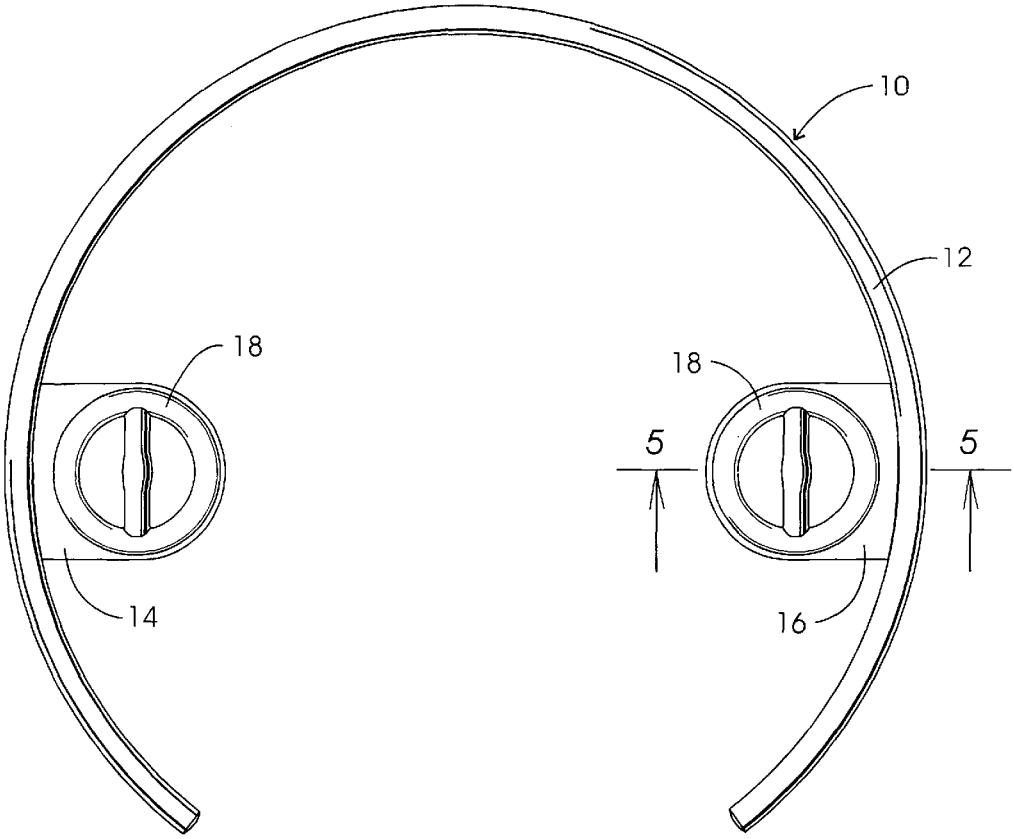
FIG. 1 is plan view of a preferred embodiment of the upper body exerciser assembly invention.
Figure 2:
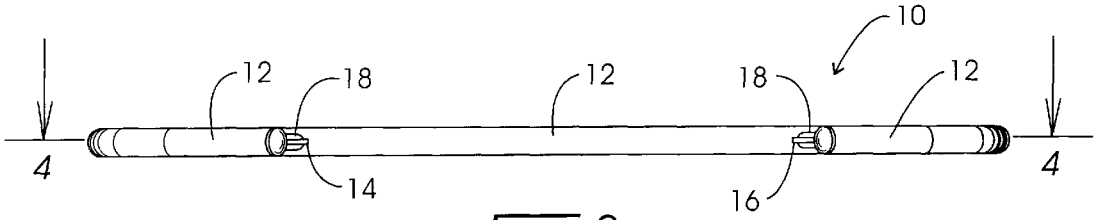
FIG. 2 is a front elevation view of the assembly of FIG. 1.
Figure 3:
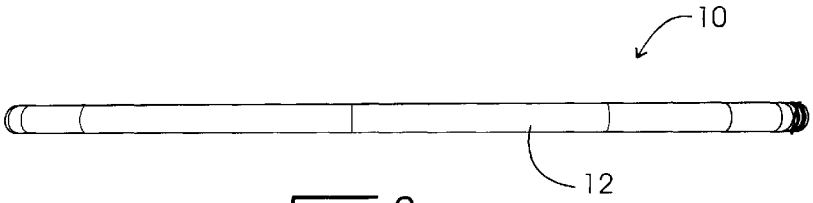
FIG. 3 is a side elevation view of the assembly of FIG. 1.
Figure 4:
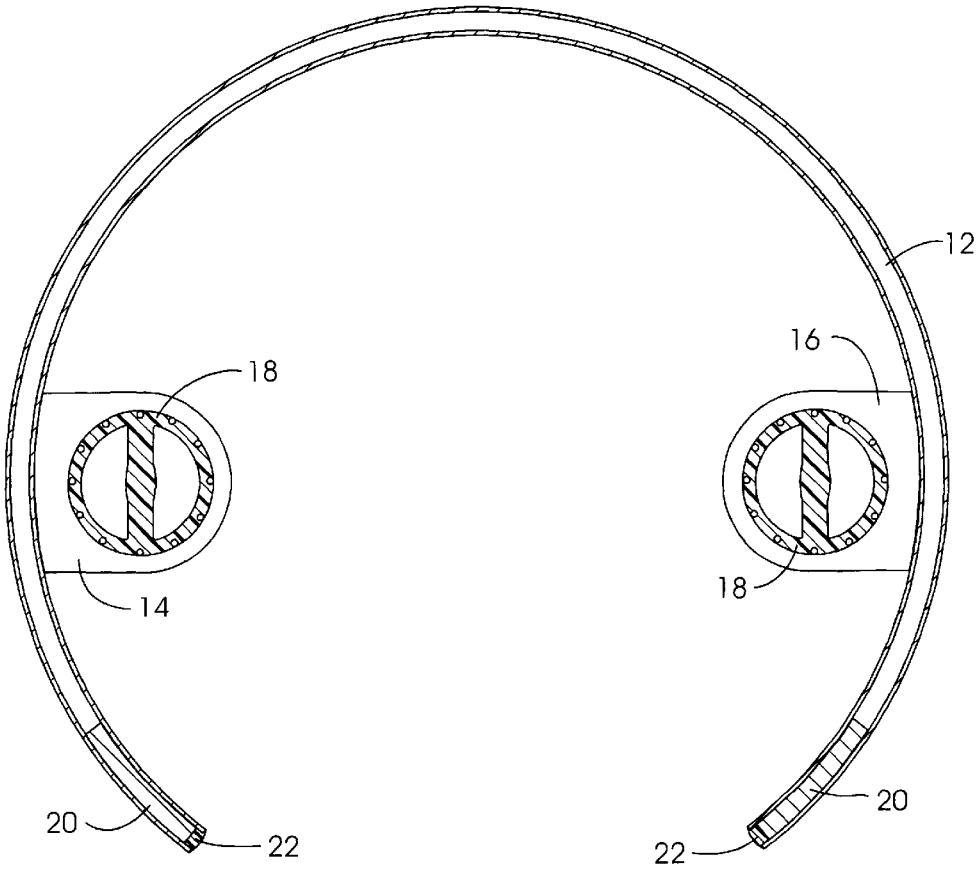
FIG. 4 is a section view taken at line 44 of FIG. 2.
Figure 5:
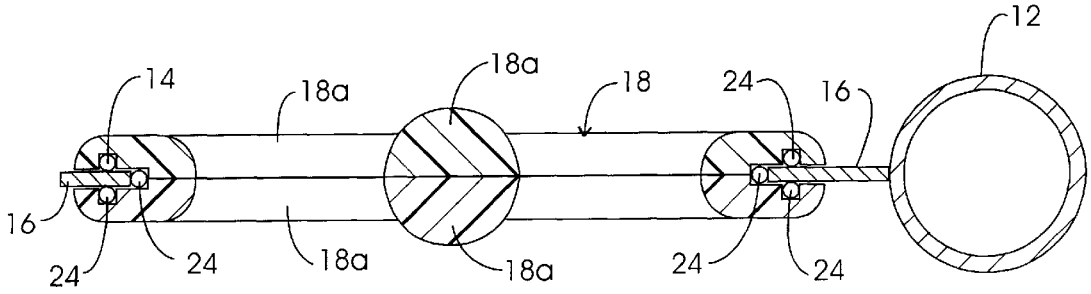
FIG. 5 is a handgrip installation section view taken at line 5—5 of FIG. 1.

Referring to FIG. 1, upper body exerciser assembly 10 is a preferred embodiment of the present invention and is basically comprised of a stainless steel tubular metal frame 12 having a nearly full-circle configuration, a pair of diametrically-opposed handgrip mounts 14 and 16 welded to frame 12 as shown in FIG. 5, and a pair of handgrip subassemblies 18 each installed in and carried by one of handgrip mounts 14 and 16. In the FIGS. 1 through 7 embodiment of the invention there are further included balancing weights 20, inserted inside tubular frame 12 at each end, and the friction-fit end closures 22. Such weights function to balance assembly 10 gravitationally relative to an axis passing through the geometric centers of handgrip mounts 14 and 16. The embodiment 100 of the invention illustrated in FIG. 8 of the drawings incorporates a rigid tubular metal frame 102 that has a full-circle configuration, and accordingly does not require the insertion of weights to obtain gravitational assembly balancing.

As shown in the section view of FIG. 5, assembly 10 further includes ball bearings 24. Also as shown in that view, handgrip subassembly 18 is preferably comprised of two identical handgrip halves 18*a*. Each handgrip half 18*a* (see FIG. 5) is preferably molded of a plastic resin having high impact strength such as high-density polyethylene. Further, co-operating handgrip halves 18*a* are joined together using a conventional high-strength adhesive, selected to be compatible with the plastic resin employed, at the time of the insertion of ball bearings 24 and completion of each handgrip subassembly 18.

Figure 6:
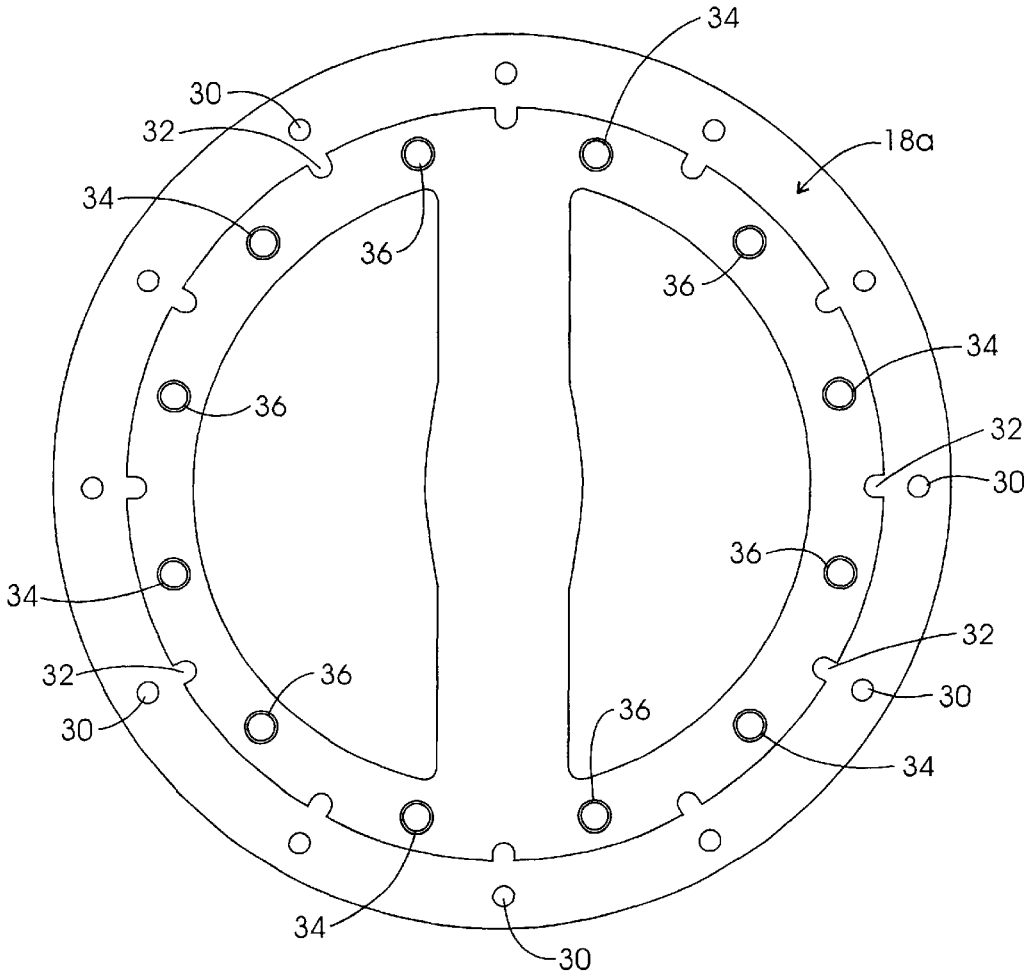
FIG. 6 is a plan view of a handgrip molded half.
Figure 7:
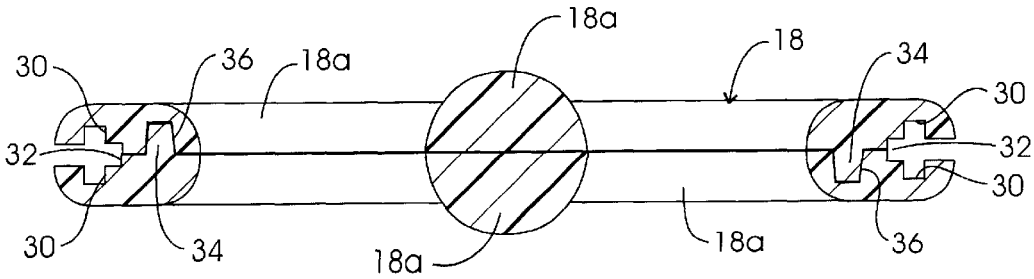
FIG. 7 is section view illustrating the joined relationship of co-operating handgrip halves.
Figure 8:
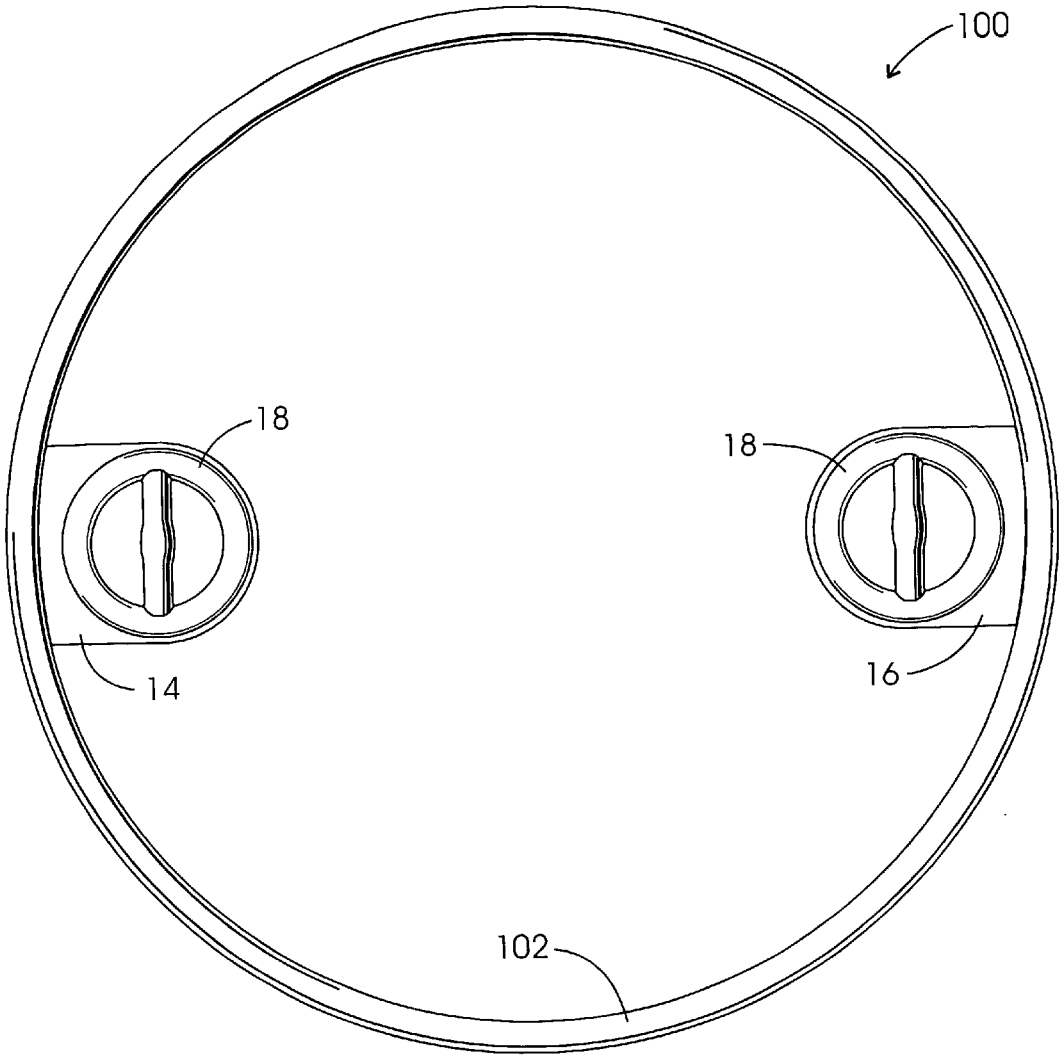
FIG. 8 is plan view of an alternate embodiment of the upper body exerciser assembly invention.

Referring to FIG. 6, handgrip half 18*a* is provided with integrally molded bearing recesses 30 and 32 which each function to contain a respective ball bearing 24. Also, each handgrip half 18*a* is provided with co-operating (upon assembly) tapered joinder projections 34 and tapered joinder recesses 36. Elements 34 and 36, are integrally molded in the handgrip half, are alternated in position with each other, and provide the surfaces for cementing each pair of co-operating handgrip halves 18*a* together. FIG. 7 illustrates the co-operating relationships which exist between the elements 30 through 36 upon the joining of handgrip subassembly halves 18*a*.

Upper body exerciser assembly 10 is sized so the user can conveniently position his torso within tubular frame 12 with arms extended straight and holding handgrip subassemblies 18. Repeated rightward and leftward full twisting of the user's body at the waist while properly holding assembly 10 will markedly improve the conditioning of the user's upper body joints and muscles.

Various changes may be made to the shape, size, proportioning, and materials of construction of the disclosed invention without departing from the meaning, scope, or intent of the claims which follow:

I claim as my invention:

1. An upper body exerciser assembly comprising:

a part-circular rigid tubular frame sized to encircle and receive the torso of the assembly user;

a pair of planar handgrip mounts each having a handgrip opening and being rigidly joined to the inner periphery of said tubular frame in a diametrically-opposed relationship relative to the other of the pair so that each planar handgrip mount and said tubular frame occupy a substantially common plane, and a pair of handgrips each of which is mounted in a different one of said planar handgrip mount handgrip openings and is rotatable relative thereto with in said common plane.

2. The invention defined by claim 1, and wherein each of said handgrips are supported on surfaces of its respective planar handgrip mount by multiple ball bearings.

3. The invention defined by claim 1, and wherein said pair of handgrips are each comprised of a joined pair of identically-configured upper and lower handgrip halves, each said handgrip half being provided with circumferentially spaced-apart ball bearing recesses.

4. The invention defined by claim 3, and wherein said ball bearing recesses contain ball bearings that contact the upper, lower, and inner surfaces of said planar handgrip mount adjacent said a respective handgrip mount handgrip opening.

5. An upper body exercise assembly comprising:

a circular rigid tubular frame sized to encircle and receive the torso of the assembly user, a pair of planar handgrip mounts each having a handgrip opening and being rigidly joined to the inner periphery of said tubular frame in a diametrically-opposed relationship relative to the other of the pair so that each planar handgrip mount and said tubular frame occupy a substantially common plane, and a pair of handgrips each of which is mounted in a different one of said planar handgrip mount handgrip openings and is rotatable relative thereto within said common place.

6. The invention defined by claim 5, and wherein each of said handgrips are supported on surfaces of its respective planar handgrip mount by multiple ball bearings.

7. The invention defined by claim 5, and wherein said pair of handgrips are each comprised of a joined pair of identically-configured upper and lower handgrip halves, each said handgrip half being provided with circumferentially spaced-apart ball bearing recesses.

8. The invention defined by claim 7, and wherein said ball bearing recesses contain ball bearings that contact the upper, lower, and inner surfaces of said planar handgrip mount adjacent said a respective handgrip mount handgrip opening.

9. An upper body exerciser assembly comprising:

a part-circular rigid tubular frame sized to encircle the torso of the assembly user;

a pair of planar handgrip mounts each having a handgrip opening and being rigidly joined to the inner periphery of said tubular frame in a diametrically-opposed relationship relative to the other of the pair;

a pair of handgrips each of which is mounted in a different one of said planar handgrip mount handgrip openings and is rotatable relative thereto; and balancing weights inserted in each end of said part-circular rigid tubular frame.

* * * * *